US012667172B2

(12) United States Patent
Popwell et al.

(10) Patent No.: US 12,667,172 B2
(45) Date of Patent: Jun. 30, 2026

(54) CONTACT LENS PACKAGES HAVING LENS LIFTING ARMS AND METHODS OF HANDLING

(71) Applicant: JOHNSON & JOHNSON VISION CARE, INC., Jacksonville, FL (US)

(72) Inventors: Sam Jonathan Popwell, Jacksonville, FL (US); Daniel Graham Ward, Cambridge (GB); Stephen Sams, Cambridge (GB); William Stephen Honey, Bath (GB)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

(21) Appl. No.: 18/712,378

(22) PCT Filed: Dec. 8, 2022

(86) PCT No.: PCT/IB2022/061946
§ 371 (c)(1),
(2) Date: May 22, 2024

(87) PCT Pub. No.: WO2023/105469
PCT Pub. Date: Jun. 15, 2023

(65) Prior Publication Data

US 2025/0009094 A1 Jan. 9, 2025

Related U.S. Application Data

(60) Provisional application No. 63/287,417, filed on Dec. 8, 2021.

(51) Int. Cl.
*A45C 11/00* (2006.01)
*B65B 5/02* (2006.01)
(Continued)

(52) U.S. Cl.
CPC ..... *A45C 11/005* (2013.01); *B65B 5/02* (2013.01); *B65B 25/008* (2013.01); *B65B 55/22* (2013.01)

(58) Field of Classification Search
CPC ..... A45C 11/005; B65B 25/008
(Continued)

(56) References Cited

U.S. PATENT DOCUMENTS 1,682,719 A 8/1928 Aldrich
3,088,830 A 5/1963 Graham
(Continued)

FOREIGN PATENT DOCUMENTS

BR 202016013147 U2 4/2019
CN 1918048 A 2/2007
(Continued)

OTHER PUBLICATIONS

International Search Report and Written Opinion for International Application No. PCT/IB2022/061946, mailed Mar. 27, 2023, 15 Pages.

(Continued)

*Primary Examiner* — Steven A. Reynolds
(74) *Attorney, Agent, or Firm* — Casimir Jones, S.C.; Thomas J. Lyneis

(57) ABSTRACT

The present invention relates to improved contact lens packages comprising arms and methods of use. A contact lens package (100) houses a contact lens (138) and packaging solution and is configured to lift via arms (134, 144) the contact lens out of the packaging solution when the lid (106) is removed.

28 Claims, 3 Drawing Sheets

(51) Int. Cl.
*B65B 25/00* (2006.01)
*B65B 55/22* (2006.01)

(58) Field of Classification Search
USPC ..... 206/5.1, 804
See application file for complete search history.

(56) References Cited

U.S. PATENT DOCUMENTS

| | | | |
|---|---|---|---|
| 3,089,500 | A | 5/1963 | Stalcup |
| 3,159,308 | A | 12/1964 | Lawrence et al. |
| 3,369,656 | A | 2/1968 | Skinner, Jr. et al. |
| 3,414,117 | A | 12/1968 | Leeds |
| 3,473,886 | A | 10/1969 | Leeds et al. |
| 3,490,806 | A | 1/1970 | Lopez-Calleja et al. |
| 3,524,455 | A | 8/1970 | Hoogesteger et al. |
| 3,584,908 | A | 6/1971 | Ray et al. |
| 3,977,517 | A | 8/1976 | Kadlecik et al. |
| 4,187,574 | A | 2/1980 | Wrue |
| 4,392,569 | A | 7/1983 | Shoup |
| 4,415,076 | A | 11/1983 | Campbell |
| 4,444,307 | A | 4/1984 | Jermyn |
| 4,495,313 | A | 1/1985 | Larsen |
| 4,512,601 | A | 4/1985 | Jacobstein |
| 4,659,782 | A | 4/1987 | Spinelli |
| 4,659,783 | A | 4/1987 | Spinelli |
| 4,691,820 | A | 9/1987 | Martinez |
| 4,889,664 | A | 12/1989 | Kindt-Larsen et al. |
| 4,942,959 | A | 7/1990 | Sauber et al. |
| 4,951,811 | A | 8/1990 | Lines |
| 4,984,682 | A | 1/1991 | Cummins |
| 4,986,414 | A | 1/1991 | Ashley et al. |
| 5,031,622 | A | 7/1991 | Lahaye |
| 5,039,459 | A | 8/1991 | Kindt-Larsen et al. |
| 5,053,208 | A | 10/1991 | Seamons et al. |
| 5,099,987 | A | 3/1992 | Bieri |
| 5,227,039 | A | 7/1993 | Pankow |
| 5,244,981 | A | 9/1993 | Seidner et al. |
| 5,314,960 | A | 5/1994 | Spinelli et al. |
| 5,331,067 | A | 7/1994 | Seidner et al. |
| 5,371,147 | A | 12/1994 | Spinelli et al. |
| 5,375,698 | A | 12/1994 | Ewart et al. |
| 5,407,062 | A | 4/1995 | Shannon et al. |
| 5,415,275 | A | 5/1995 | Girimont |
| 5,452,027 | A | 9/1995 | Tylec |
| 5,474,169 | A | 12/1995 | Bauman |
| 5,515,964 | A | 5/1996 | Bauman |
| 5,609,246 | A | 3/1997 | Borghorst et al. |
| 5,620,088 | A | 4/1997 | Martin et al. |
| 5,695,049 | A | 12/1997 | Bauman |
| 5,704,468 | A | 1/1998 | Lust et al. |
| 5,711,416 | A | 1/1998 | Bauman |
| 5,722,536 | A | 3/1998 | Pierce et al. |
| 5,732,990 | A | 3/1998 | Yavitz et al. |
| 5,760,100 | A | 6/1998 | Nicolson et al. |
| 5,776,999 | A | 7/1998 | Nicolson et al. |
| 5,789,461 | A | 8/1998 | Nicolson et al. |
| 5,849,811 | A | 12/1998 | Nicolson et al. |
| 5,853,085 | A | 12/1998 | Luttrell |
| 5,965,631 | A | 10/1999 | Nicolson et al. |
| 5,998,498 | A | 12/1999 | Vanderlaan et al. |
| 6,010,001 | A | 1/2000 | Osborn, III |
| 6,087,415 | A | 7/2000 | Vanderlaan et al. |
| 6,138,212 | A | 10/2000 | Chiacchia et al. |
| 6,138,312 | A | 10/2000 | Cummings |
| 6,253,912 | B1 | 7/2001 | O'Neill et al. |
| 6,260,695 | B1 | 7/2001 | Tasber et al. |
| 6,276,797 | B1 | 8/2001 | Shannon |
| 6,280,530 | B1 | 8/2001 | Pankow |
| 6,286,666 | B1 | 9/2001 | Umdasch |
| 6,289,907 | B1 | 9/2001 | Horian |
| RE37,558 | E | 2/2002 | Abrams et al. |
| 6,367,929 | B1 | 4/2002 | Maiden et al. |
| 6,401,915 | B1 | 6/2002 | Faxe |
| 6,572,165 | B2 | 6/2003 | Faxe et al. |
| 6,822,016 | B2 | 11/2004 | McCabe et al. |
| 6,867,245 | B2 | 3/2005 | Iwata et al. |
| 6,943,203 | B2 | 9/2005 | Vanderlaan et al. |
| 7,086,526 | B2 | 8/2006 | Newman |
| 7,225,919 | B2 | 6/2007 | Hamilton |
| 7,247,692 | B2 | 7/2007 | Laredo |
| 7,249,848 | B2 | 7/2007 | Laredo et al. |
| 7,275,275 | B2 | 10/2007 | Pankow et al. |
| 7,398,877 | B1 | 7/2008 | Nelson et al. |
| 7,410,050 | B2 | 8/2008 | Py et al. |
| 7,426,993 | B2 | 9/2008 | Coldrey et al. |
| 7,441,650 | B2 | 10/2008 | Tanaka et al. |
| 7,461,740 | B2 | 12/2008 | Newman |
| 7,540,376 | B2 | 6/2009 | Mahieu et al. |
| 7,553,880 | B2 | 6/2009 | Nicolson et al. |
| 7,666,921 | B2 | 2/2010 | McCabe et al. |
| 7,786,185 | B2 | 8/2010 | Rathore et al. |
| 7,819,241 | B2 | 10/2010 | Post-Smith et al. |
| 7,832,551 | B2 | 11/2010 | Newman et al. |
| 7,832,552 | B2 | 11/2010 | Newman |
| 7,850,002 | B2 | 12/2010 | Newman |
| 7,938,255 | B2 | 5/2011 | Newman |
| 7,956,131 | B2 | 6/2011 | Arnold et al. |
| 8,022,158 | B2 | 9/2011 | Rathore et al. |
| 8,104,608 | B2 | 1/2012 | Newman |
| D658,077 | S | 4/2012 | Newman |
| 8,251,205 | B2 | 8/2012 | Azera |
| 8,273,802 | B2 | 9/2012 | Laredo et al. |
| 8,399,538 | B2 | 3/2013 | Steffen et al. |
| 8,450,387 | B2 | 5/2013 | Mccabe et al. |
| 8,470,906 | B2 | 6/2013 | Rathore et al. |
| 8,487,058 | B2 | 7/2013 | Liu et al. |
| 8,507,577 | B2 | 8/2013 | Zanini et al. |
| D690,207 | S | 9/2013 | Newman |
| 8,637,621 | B2 | 1/2014 | Iwata et al. |
| 8,703,891 | B2 | 4/2014 | Broad |
| 8,833,548 | B2 | 9/2014 | Hsieh et al. |
| 8,881,892 | B1 | 11/2014 | Linhardt et al. |
| 8,937,110 | B2 | 1/2015 | Alli et al. |
| 8,937,111 | B2 | 1/2015 | Alli et al. |
| 8,940,812 | B2 | 1/2015 | Reboul et al. |
| 9,044,075 | B2 | 6/2015 | Linhardt et al. |
| 9,056,878 | B2 | 6/2015 | Fujisawa et al. |
| 9,057,821 | B2 | 6/2015 | Broad et al. |
| 9,067,720 | B2 | 6/2015 | Howell et al. |
| 9,095,195 | B2 | 8/2015 | Mori |
| 9,125,808 | B2 | 9/2015 | Alli et al. |
| 9,140,825 | B2 | 9/2015 | Alli et al. |
| 9,156,934 | B2 | 10/2015 | Alli et al. |
| 9,170,349 | B2 | 10/2015 | Mahadevan et al. |
| 9,206,544 | B2 | 12/2015 | Zeng et al. |
| 9,244,196 | B2 | 1/2016 | Scales et al. |
| 9,244,197 | B2 | 1/2016 | Alli et al. |
| 9,260,544 | B2 | 2/2016 | Rathore et al. |
| 9,297,928 | B2 | 3/2016 | Molock et al. |
| 9,297,929 | B2 | 3/2016 | Scales et al. |
| 9,320,566 | B1 | 4/2016 | Alston, Jr. et al. |
| 9,358,736 | B2 | 6/2016 | Wang et al. |
| 9,576,609 | B2 | 2/2017 | Huang et al. |
| 9,668,558 | B2 | 6/2017 | Clamp et al. |
| 9,701,458 | B2 | 7/2017 | Barrows et al. |
| D804,323 | S | 12/2017 | Harrison et al. |
| D805,920 | S | 12/2017 | Clamp |
| 9,839,270 | B2 | 12/2017 | Howell et al. |
| D813,537 | S | 3/2018 | Miura et al. |
| 10,092,075 | B2 | 10/2018 | Barre et al. |
| 10,138,042 | B2 | 11/2018 | Fawdington et al. |
| 10,194,724 | B2 | 2/2019 | Newman |
| 10,364,082 | B2 | 7/2019 | Coon et al. |
| 10,368,621 | B2 | 8/2019 | Barre et al. |
| 10,463,127 | B2 | 11/2019 | Kim |
| 10,577,166 | B2 | 3/2020 | Barrows et al. |
| 10,661,964 | B2 | 5/2020 | Tokarski et al. |
| D899,080 | S | 10/2020 | Yasuda et al. |
| D899,081 | S | 10/2020 | Yamamoto et al. |
| 10,901,236 | B2 | 1/2021 | Schweizer et al. |
| 10,926,944 | B2 | 2/2021 | Huang |
| 11,071,644 | B2 | 7/2021 | Greenwood et al. |
| 11,077,969 | B2 | 8/2021 | Newman |
| 11,136,176 | B2 | 10/2021 | Almond et al. |

(56) References Cited

U.S. PATENT DOCUMENTS

| | | | | |
|---|---|---|---|---|
| 11,229,266 | B2 | 1/2022 | Almond et al. | |
| 11,628,998 | B2 | 4/2023 | Ho et al. | |
| 11,649,099 | B2 | 5/2023 | Ellis et al. | |
| 11,751,654 | B2 | 9/2023 | Lansing et al. | |
| 2001/0017271 | A1 | 8/2001 | Yavitz | |
| 2002/0158477 | A1 | 10/2002 | Faxe et al. | |
| 2002/0163212 | A1 | 11/2002 | Py | |
| 2004/0134005 | A1 | 7/2004 | Pankow et al. | |
| 2004/0150238 | A1 | 8/2004 | Jeoung | |
| 2004/0238380 | A1 | 12/2004 | Newman | |
| 2005/0087453 | A1* | 4/2005 | Mahieu | A45C 11/005 206/5.1 |
| 2005/0103649 | A1 | 5/2005 | Vulcu et al. | |
| 2005/0218012 | A1 | 10/2005 | Tanaka et al. | |
| 2006/0011496 | A1 | 1/2006 | Mangabeira Nunez | |
| 2006/0201103 | A1 | 9/2006 | Tokarski et al. | |
| 2006/0213783 | A1 | 9/2006 | Tokarski et al. | |
| 2006/0213784 | A1 | 9/2006 | Tokarski et al. | |
| 2006/0219577 | A1 | 10/2006 | Newman | |
| 2006/0260956 | A1 | 11/2006 | Stachowski et al. | |
| 2006/0260957 | A1 | 11/2006 | Hamilton | |
| 2007/0000792 | A1 | 1/2007 | Newman et al. | |
| 2007/0164576 | A1 | 7/2007 | Kim | |
| 2008/0011619 | A1 | 1/2008 | Newman | |
| 2008/0047848 | A1* | 2/2008 | Tokarski | B65D 75/366 206/5.1 |
| 2008/0078681 | A1 | 4/2008 | Newman | |
| 2008/0170201 | A1 | 7/2008 | Filippo | |
| 2009/0121370 | A1 | 5/2009 | Barrows et al. | |
| 2009/0139879 | A1 | 6/2009 | Tokarski et al. | |
| 2009/0200182 | A1 | 8/2009 | Post-Smith et al. | |
| 2010/0048847 | A1 | 2/2010 | Broad | |
| 2010/0072082 | A1* | 3/2010 | Kang | A45C 11/005 206/5.1 |
| 2010/0187140 | A1 | 7/2010 | Tokarski et al. | |
| 2011/0017243 | A1 | 1/2011 | Voss et al. | |
| 2012/0267262 | A1 | 10/2012 | Wang et al. | |
| 2013/0091613 | A1 | 4/2013 | Meltzner | |
| 2013/0277242 | A1 | 10/2013 | Mori | |
| 2014/0001059 | A1 | 1/2014 | Hsieh et al. | |
| 2014/0027462 | A1 | 1/2014 | Willat et al. | |
| 2014/0027465 | A1* | 1/2014 | Howell | A45C 13/34 221/154 |
| 2014/0246337 | A1 | 9/2014 | Newman | |
| 2015/0014187 | A1 | 1/2015 | Gilman et al. | |
| 2015/0150346 | A1 | 6/2015 | Yasuda et al. | |
| 2015/0173474 | A1 | 6/2015 | Barrows et al. | |
| 2015/0296943 | A1 | 10/2015 | Howell et al. | |
| 2016/0198825 | A1* | 7/2016 | Fawdington | A45C 11/005 206/5.1 |
| 2017/0172269 | A1 | 6/2017 | Lin | |
| 2018/0134475 | A1 | 5/2018 | Newman | |
| 2018/0340622 | A1 | 11/2018 | Godfrey | |
| 2019/0046353 | A1 | 2/2019 | Greenwood et al. | |
| 2019/0133275 | A1 | 5/2019 | Newman | |
| 2019/0270543 | A1 | 9/2019 | Namazie et al. | |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1* | 7/2020 | Almond | B65D 75/326 |
| 2020/0383440 | A1 | 12/2020 | Newman | |
| 2021/0139229 | A1 | 5/2021 | Huang | |
| 2022/0330671 | A1 | 10/2022 | Bruchon et al. | |
| 2022/0365368 | A1 | 11/2022 | Greenwood et al. | |
| 2023/0083028 | A1* | 3/2023 | Popwell | B65D 75/326 206/5.1 |
| 2023/0276917 | A1* | 9/2023 | Popwell | A45C 11/005 206/5.1 |
| 2025/0049184 | A1 | 2/2025 | Popwell et al. | |
| 2025/0058950 | A1 | 2/2025 | Popwell et al. | |

FOREIGN PATENT DOCUMENTS

| | | | |
|---|---|---|---|
| CN | 101662967 | A | 3/2010 |
| CN | 111759065 | A | 10/2020 |
| DE | 4415003 | C1 | 6/1995 |
| DE | 202006004323 | U1 | 5/2006 |
| EP | 0269367 | A2 | 6/1988 |
| EP | 3045071 | A1 | 7/2016 |
| EP | 2768465 | B1 | 9/2019 |
| FR | 2712398 | A1 | 5/1995 |
| FR | 2777360 | A1 | 10/1999 |
| GB | 2551530 | A | 12/2017 |
| JP | H01279222 | A | 11/1989 |
| JP | H10313928 | A | 12/1998 |
| JP | 2001046134 | A | 2/2001 |
| JP | 5184925 | B2 | 4/2013 |
| JP | 2014218255 | A | 11/2014 |
| JP | 6004912 | B2 | 10/2016 |
| JP | 2016179837 | A | 10/2016 |
| JP | 6129238 | B2 | 5/2017 |
| JP | 6129239 | B2 | 5/2017 |
| JP | 6339322 | B2 | 6/2018 |
| KR | 100768522 | B1 | 10/2007 |
| KR | 20080066930 | A | 7/2008 |
| KR | 20080090252 | A | 10/2008 |
| KR | 20090060075 | A | 6/2009 |
| KR | 20100002433 | A | 1/2010 |
| KR | 101495874 | B1 | 2/2015 |
| KR | 20160064382 | A | 6/2016 |
| KR | 20170079398 | A | 7/2017 |
| KR | 20190003113 | U | 12/2019 |
| KR | 200490803 | Y1 | 2/2020 |
| NL | 2000268 | C2 | 4/2008 |
| TW | 200930318 | A | 7/2009 |
| TW | D159617 | S | 4/2014 |
| TW | D172590 | S | 12/2015 |
| WO | WO-9921519 | A1 | 5/1999 |
| WO | WO-02088780 | A2 | 11/2002 |
| WO | WO-03022321 | A2 | 3/2003 |
| WO | WO-2005006062 | A1 | 1/2005 |
| WO | WO-2005055760 | A1 | 6/2005 |
| WO | WO-2005073105 | A2 | 8/2005 |
| WO | WO-2005082721 | A2 | 9/2005 |
| WO | WO-2006068583 | A1 | 6/2006 |
| WO | WO-2006105179 | A1 | 10/2006 |
| WO | WO-2008061992 | A2 | 5/2008 |
| WO | WO-2008120954 | A1 | 10/2008 |
| WO | WO-2009059231 | A1 | 5/2009 |
| WO | WO-2009069265 | A1 | 6/2009 |
| WO | WO-2012165209 | A1 | 12/2012 |
| WO | WO-2012168964 | A1 | 12/2012 |
| WO | WO-2013058712 | A1 | 4/2013 |
| WO | WO-2013134547 | A1 | 9/2013 |
| WO | WO-2013136361 | A1 | 9/2013 |
| WO | WO-2013153582 | A1 | 10/2013 |
| WO | WO-2014185354 | A1 | 11/2014 |
| WO | WO-2014195588 | A1 | 12/2014 |
| WO | WO-2015150704 | A1 | 10/2015 |
| WO | 2017098168 | A1 | 6/2017 |
| WO | WO-2017137738 | A1 | 8/2017 |
| WO | 2017220684 | A1 | 12/2017 |
| WO | WO-2019013199 | A1 | 1/2019 |
| WO | WO-2020152444 | A1 | 7/2020 |
| WO | WO-2020152446 | A1 | 7/2020 |
| WO | WO-2021176760 | A1 | 9/2021 |
| WO | WO-2021260353 | A1 | 12/2021 |
| WO | WO-2022054031 | A2 | 3/2022 |
| WO | WO-2022054033 | A2 | 3/2022 |
| WO | WO-2022123525 | A1 | 6/2022 |

OTHER PUBLICATIONS

International Search Report and Written Opinion for International Application No. PCT/IB2022/062305, mailed Mar. 28, 2023, 12 Pages.

International Search Report and Written Opinion for International Application No. PCT/IB2022/061947, mailed Feb. 15, 2023, 14 Pages.

(56) References Cited

OTHER PUBLICATIONS

International Search Report and Written Opinion for International Application No. PCT/IB2022/062129, mailed Mar. 16, 2023, 14 Pages.

* cited by examiner

CONTACT LENS PACKAGES HAVING LENS LIFTING ARMS AND METHODS OF HANDLING

I. BACKGROUND OF THE INVENTION

In a conventional contact lens package, the contact lens typically sits in a molded plastic base having a cavity (or "bowl") that houses the contact lens in a concave-side-up orientation. As a result, the user experience for transferring a contact lens from the package to an eye generally involves the user "fishing" the contact lens out of the bowl with a finger and then flipping the lens so that it is in the correct orientation on the finger for placement on the eye. This process requires touching the lens multiple times, which can transfer contaminants or pathogens from the hand to the lens and ultimately to the eye. Not only is this handling experience unsanitary, but it is also unduly cumbersome, messy, and mechanically stressful to the lens, which can tear, rip, or distort when overly manipulated. While some packages have been designed to present the lens in a convex-side-up orientation to obviate the need for flipping the lens, they often still require the lens to be "fished" from the packaging solution or otherwise necessitate manipulation of the lens and/or multiple touches of the lens to achieve transfer of the lens to the eye.

In view of the growing awareness around ocular health and the customer demand for a more convenient experience, a need has arisen for contact lens packaging that enables a less messy and more sanitary contact lens handling process. In one respect, it would be ideal to provide wearers of contact lenses with a "single touch" package—that is, a package whereby the wearer of contact lenses can take the lens from the lens storage package with a single touch of one of his or her fingers, and then, with this single touch, position the lens correctly on the eye. In such a design, there would be no need for transfer and manipulation of the lens from one finger to another before placing the lens on the eye. Providing such a single touch package would not only streamline the lens preparation and insertion process; it would also diminish the possibility of dropping the lens or exposing the lens to additional bacteria on a wearer's other fingers as the lens is being prepared for orientation and insertion onto the eye, and it also reduces the possibility of touching the side of the lens which is intended to contact the eye.

Design of a single touch lens package faces some distinct challenges. The wearer ideally should be able to consistently position the lens to adhere to the finger during removal from the package. Contact lenses (of both the reusable and daily disposable variety) each has its own unique surface, bulk, and geometric properties. Further, the single touch package ideally should not result in an inordinate increase in the cost of goods over current contact lens packages, as this could result in increased costs to the wearer community. The package should not make it difficult to hold the lens when removed from the package. Additionally, if the configuration of the package were to maintain, or even reduce the volume of solution needed to package the lens, this would reduce the ecological impact of the lens package. Similarly, it would be beneficial if all or part of the package could be made of recycled materials, and/or recyclable in whole or part.

In addition, it would be advantageous if the package were composed of materials that are already approved by the various regulatory bodies and ideally did not require a change in solution chemistry or lens composition. Optimally, as well, the functionality of the package preferably does not incorporate any electronics or other electrical components if such components could adversely affect performance of either the package or the lens.

Thus, there remains a need for contact lens packages which provide a consistent convenient single-touch lens removal experience.

II. SUMMARY

It has now been found that some or all the foregoing and related objects may be attained in a contact lens package having one or more aspects described herein. For example, a contact lens package of the invention may house a contact lens and packaging solution wherein the package is configured to lift the contact lens out of the packaging solution when the lid is opened. In accordance with principles described herein, a contact lens package includes a package base having a recessed well for receiving said contact lens therein; and arms connected to the package base and having an end spaced from the package base. The end is extendable into the recessed well to a position adjacent the position of the contact lens, the arm movable out of the recessed well. The arms may be biased away from the well. There is surface tension between the contact lens and at least one of the arms, i.e., an arm above the lens, such that the contact lens such that the lens is retained and presented for transfer on the arm when the package is in an opened state. The arms may be attached to the package base adjacent the rim of the recessed well. The arms may be a single strip connected to the package base at a central portion of the strip.

The contact lens package includes a lid that is movably connected to the package. The lid may pivot with respect to the package base. The lid may be foil. The end of the arms may be affixed to the lid, in an aspect by surface tension. The recessed well may be a blister bowl integral to the package base. The arms may be made of polymer, such as polypropylene. The arms may be a strip having two or three free edges.

In another aspect, a contact lens package has a closed state and an opened state. In the closed state, a contact lens is contained in the contact lens package. The contact lens package includes a package base having a recessed well for receiving said contact lens therein; a lid sized to cover the recessed well in said closed state and fixed to a region of the base; and an arm having a base region connected to the base and an end spaced from the base region, the arm biased toward the lid. In the closed state, the end of the arms extend into the recessed well and in an opened state, the arm is adjacent the lid such that the contact lens is adjacent the arms. The arms may have one or both of its ends attached to the lid. The base region of the arms may be near the recessed well. The package base may further include a grip region. The lid is removably connected to the package base such that the lid is removable pivotally with respect to a lid connection edge. In an aspect, the lid is foil and the foil is peelably removable from the package base. In an aspect, in the closed state, the contact lens is adjacent the arms in the recessed well, the lid is hermetically sealed to the package base, and the lid is partially detachable from the base such that upon detachment at least a portion of the lid remains pivotally connected to the package base, and upon detachment, the lid is moved to an open position wherein the arms are biased toward the lid and the contact lens is retained on the arm outside the recessed well by surface tension. In another aspect, the end of one or both of the arms is attached to the cover wherein, in the closed state, the contact lens is adjacent the arms in the recessed well, the lid is hermetically sealed to the package base, and the lid is partially detachable from the base such that upon detachment the lid remains pivotally connected to the package base, and upon detachment, the lid is moved to an open position wherein the end is moved away from the recessed well with the lid and the contact lens is held to the arm outside the recessed well by surface tension.

A method, according to principles described herein, includes moving said contact lens from said recessed well by movement of arms attached to a portion of the contact lens package, said movement from a position of the arms extending into said recessed well and initiated by opening of said contact lens package. An end of each arm is biased out of the well by a spring force and held in the recessed well before opening of the said contact lens package by a cover of said contact lens package over the recessed well. Upon opening of the contact lens package, the method includes moving first and second arms out of the recessed well, wherein prior to opening of said contact lens package, an arm extends into the recessed well to a position under said contact lens such that said contact lens is between the two arms in the recessed well before opening of said contact lens package. The arms may be affixed to the cover by any number of attachments means such as ultrasonic or heat welding or mechanical trap. The arm may be a strip and may comprise polypropylene.

In any of the embodiments, either or both arms may be a strip where one end is the end of the first arm and the other end is the end of the second arm and the strip is attached to the package base at a location on the strip between the ends of the strip and the strip is shaped to form the first arm and the second arm.

III. BRIEF DESCRIPTION OF THE DRAWINGS

The foregoing and other features and advantages of the invention will be apparent from the following, more particular description of preferred embodiments of the invention, as illustrated in the accompanying drawings.

IV. DETAILED DESCRIPTION

Figure 1:
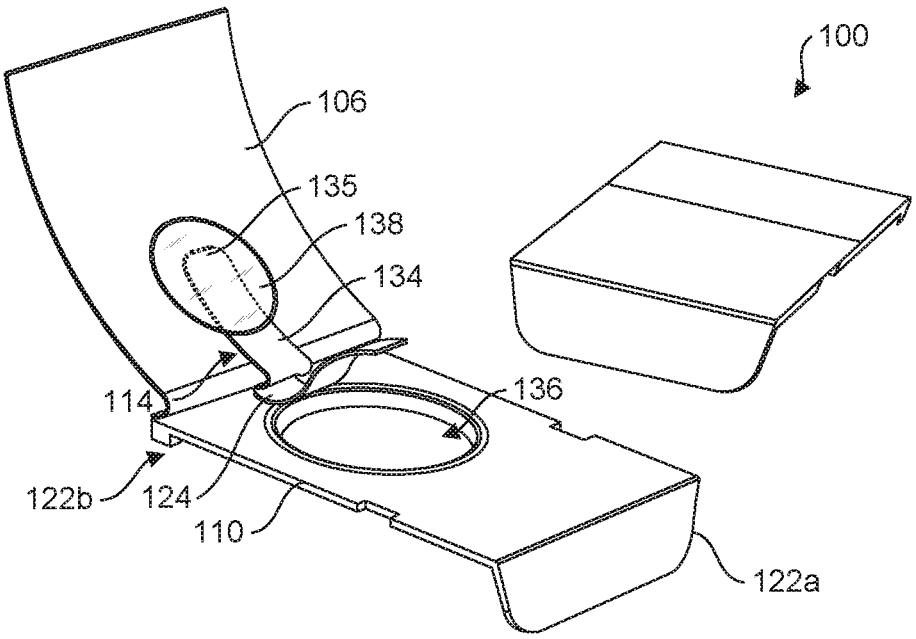
FIG. 1 illustrates a perspective view of a contact lens package in an opened state according to an embodiment.

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

As used herein, the following terms have the following meaning. A benefit of the certain embodiments the present invention is that they facilitate consistent single-touch lens transfer from the package to a wearer's finger, and then from the finger to the wearer's eye without the lens inverting, falling off the finger or further manipulation. Consistent lens transfer includes a transfer rate of at least about 70%, at least about 80% or at least about 90% transfer on the first touch of the finger (or "dab"). The lens also desirably "sits up" on the finger without collapsing or inverting and then transfers to the eye when placed there. Packages of certain embodiments may provide the desired single-touch transfer across a range of finger sizes, and dab pressures. Environmental conditions such as the temperature and whether the finger is wet or dry may also impact transfer rate, with higher temperatures generally improving lens transfer.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331, 067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 mm and about 10 mm. The lens periphery or lens edge is the edge where the anterior and posterior sides meet.

The wetted lens is the contact lens and any residual packaging solution attached to it after packaging solution drainage. Wetted contact is the aggregated contact area between the wetted lens and lens support.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after the sterile seal has been broken. Depending on the context described herein, the open state extends to the state of the package when the user has manipulated the package to cause the lens to be lifted out of the packaging solution for transfer by the user.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

The package base may form the bottom of the package. The package base may be made from selected from polymers, rubbers, or plastics that can molded and preferably be injection molded and are compatible with the chemical and physical properties of the lens, packing solution and any additives which may be included therein and sterilization requirements of contact lens manufacture. Examples of suitable materials include polyolefins including polypropylene, and olefin co-polymers, including COPs (Cyclic Olefin Polymer) and COCs, (Cyclic Olefin Co-polymers), and blends thereof.

The packaging lid generally resides at the upper portion the package and seals with the base to form a cavity containing at least a portion of the lens support, lens, and packaging solution. The lid may be made from any material suitable for packaging medical devices, including a molded sheet of foil or plastic, laminate films, or plastic.

Packages comprising plastic for one structure and foil or laminated films as the other, or packages comprising foil or laminated films as the outer layer for the lid and base are known in the art and are examples of suitable combinations.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

Certain aspects of the invention may serve to reduce or prevent significant optical damage to the contact lens due to interactions with air bubbles or the interior of the lens package that may arise during storage or transit due to gravitational or other forces, such as mechanical pressure being applied from outside of the package. As used herein, significant optical damage means a root-mean-squared (RMS) value equal or greater than about 0.08 μm.

FIG. 1 illustrates a contact lens single-touch package in an unopened state and a state in which a film used as a lid to seal the package is partially opened. As shown, an embodiment of the contact lens package 100 includes a lid 106 and a base 110. The base 110 has a recessed well or cavity 136. In an unopened state, a contact lens 138 is held in a packaging solution in the reservoir 136. An arm structure 114 is attached to an upper surface of the base 110, under the lid 106 in an unopened state. The arm structure 114, best seen in FIG. 2, has a base region 124 connected to the base 110 of the package 100 and a first/upper arm 134 having an end 135. At least a portion of the end 135 of the first arm 134 and perhaps part of the first arm 134 are extendible into the recessed well 136. The first arm 134 end 135, in and unopened state, extends into the recessed well 136 to a position adjacent to the contact lens 138.

The arm structure 114 includes a second arm 144 with an end 145 extending from the base region 124. In an unopened state, the end 135 and the end 145 may be collapsed toward each other to be oriented in the same direction in or over the recessed well 136, with the contact lens 138 stored therebetween. In other words, in an unopened state, the contact lens is stored in the solution in the recessed well 136 between the first arm 134 and the second arm 144, and perhaps between the ends 135 and 145. The contact lens 138 may be stored in the well 136 in a concave down/convex up state (as shown) such that when lifted from the recessed well 136 via the arm structure 114, the lower arm 144 pivoted downward, and surface tension between the lens and the arm structure allows the lens to be easily retrieved by the user. Or, in alternative embodiments not shown, arms of the arm structure could be curved opposite to that shown such that the lens is stored in a convex down/concave up state such that the lens apex is available to the user to dab for removable for direct application to the eye without further manipulation of the lens.

The first arm 134 and second arm 144 are movable away from and/or out of the recessed well 136, along with contact lens 138 therebetween arms 134 and 144, upon opening of the lid 106. In an aspect of the present invention, the first arm 134/end 135 is biased out of the recessed well 136 and held into the recessed well 136 by the lid 106 in an unopened state. In another aspect, the end 135 may be affixed to an underside of the lid in a position that is above the recessed well 136 in an unopened state. Upon opening of the package 100 by removal or partial removal of the lid 106 from the base 110, the end 135/arm 134 lifts out of or away from the recessed well 136. Lower arm 144 is moveable away from lens 138 and upper arm 135 to allow transfer of the lens by the user. Contact lens 138 is retained on the arm 134 and/or the end 135 by surface tension such that when the end 135 move away from the recessed well 136, the contact lens 138 moves with the arm 134 and/or the end 135. Arms may be composed of any number of materials capable of achieving the described functionality, including preferably a thermoplastic polymer, such as polypropylene plastic.

It is noted that the particular package design choices will dictate onto which arm the lens is preferably retained for transfer, e.g., in the embodiment depicted the lens 138 is retained on arm 134 when arm 144 is pivoted away. The arm onto which the lens is intended to be retained should be made to have a wetted contact area between the lens and arm that is larger than that of the wetted contact area between the lens and the arm intended to pivot away. It will also be appreciated that, while in this embodiment the lens is illustrated as having its convex side facing upward relative to the lid of the package, the alternative lens orientation is possible as well within the scope of the invention.

Figure 2:
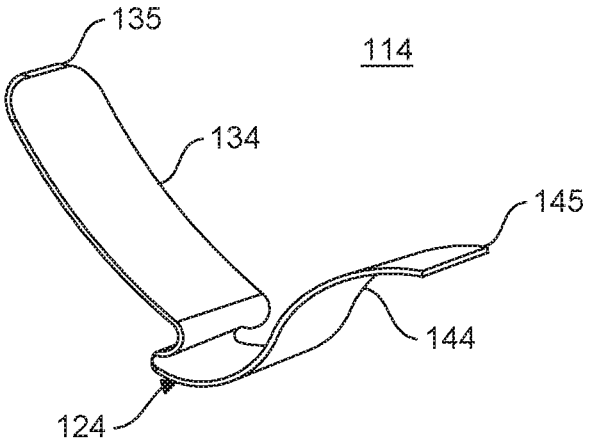
FIG. 2 illustrates an arm structure according to an embodiment of the present invention.
Figure 3A:
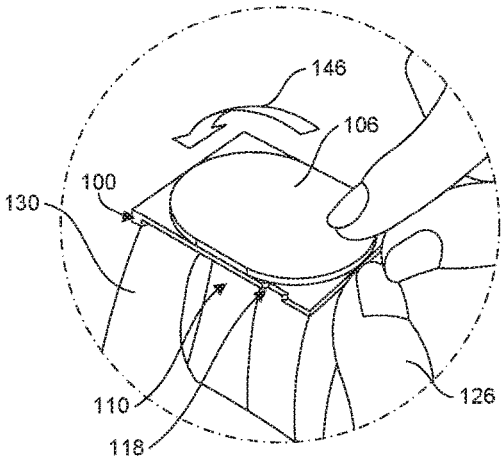
FIGS. 3A-3D illustrate steps of opening a contact lens package according to an exemplary embodiment of the present invention.

The first arm 134 may be a thin rectangular leaf or strip extending from the base region 124. Alternatively, the arm may take on any of myriad possible shapes capable of supporting the lens, including but not limited to those depicted in Appendix A. The base region 124 itself may be part of the package base 110 or may be a structure on, affixed or embedded in the package base 110. The first arm 134 and the base region 124 may together form a single structural element, for example, opposite ends of the same thin, armlike structure (e.g., leaf or strip). In some embodiments, the second arm 144 may also extend from the base region 124 such that the first arm 134 and the second arm 144 are opposite ends of the same structure, with the base region affixed to the package base 110 between the second arm 144 and the first arm 134. The first arm 134 and the second arm 144 may be shaped in such a way to facilitate the functioning of the package according to principles described herein. In an alternative embodiment, the base region 124 itself may be part of the package base 110 or may be a structure on, affixed or embedded in the package base 110 and may be integral to a structure forming the base region, such that the first arm 134 and the second arm 144 extend therefrom. When the arm is a separate structure, it may be embedded or affixed to the base region inside the heat seal (not shown), between the lid and package base, to improve the integrity of the heat seal. As illustrated in FIG. 2, the end 135 of the first arm may have rounded corners. The first arm 134 and the second arm 144 may be shaped in such a way to facilitate the functioning of the package according to principles described herein. The end 135 of the first arm 134 and the end 145 of the second arm 144 may be of any shape, but as shown in the illustrated embodiment of FIG. 2, includes rounded corners to prevent sharp edges from causing damage to the contact lens 138. Either or both of the arms can have stops at their ends 135 and 145 to prevent the contact lens from sliding off the end of the arm FIGS. 3A-D illustrate steps of opening a contact lens package according to an exemplary embodiment of the present invention. With reference to figures, FIGS. 3A-3D illustrated steps of handling a contact lens package containing a contact lens in packaging solution according to an exemplary embodiment of the present invention. An unopened contact lens package 100 having a lid 106 and a base 110 is shown in FIG. 3A. In this embodiment, the lid 106 is a multilayer film, also referred to herein as the foil, and the base 110 is made of a thermoplastic polymer, such as polypropylene plastic. While in this embodiment the lid 106 takes the form of a relatively flexible material (i.e., multilayer film) and the base 110 a relatively rigid material, it should be appreciated that other embodiments may include substantially rigid components for both the lid and the base.

For example, in some embodiments, the base 110 and the lid 106 could both be made of a polypropylene plastic or other relatively rigid material.

In a first step shown in FIG. 3A, a user holds an unopened contact lens package 100 by its base 110. The lid 106 may include a finger dimple, which may be positioned on or near a groove 118 in base 110. The dimple may be sized for a thumb 126 of the user to grip the package 100. At the opposite end of package 100, the user may grasp the package as shown by positioning a finger securely under an overhang 122*b* at the end of the base 110. In the case of an overhang, the overhanging region may be curved or may be flattened to provide an increased area across which an opposing force can be supplied when the package is squeezed. Next, the user may open the package by opening the lid 106, which in this embodiment involves the user peeling open the foil 106 from the proximal end of the base 110 to the distal end in the direction shown by arrow 146, thus breaking a sterile seal between the foil (lid) 106 and base 110. Although not required, in an embodiment the package may be optimized for the user to grasp the base with one hand and peel open the lid 106 with the other hand.

Figure 3B:
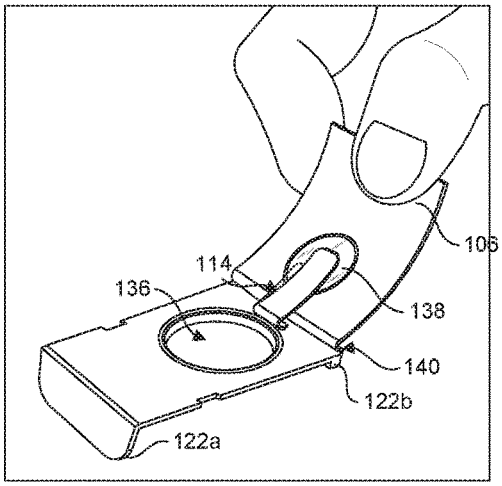
Figure 3C:
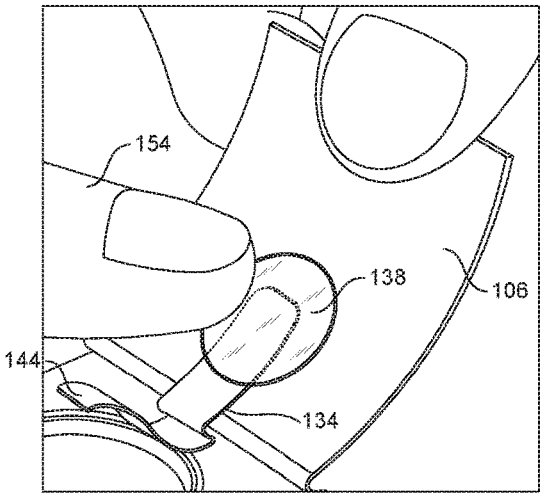
Figure 3D:
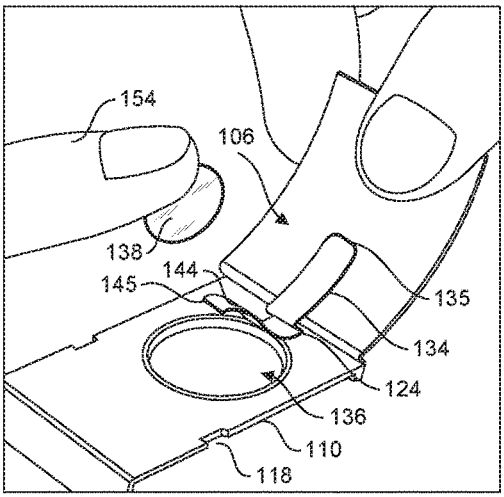

As illustrated in FIG. 3B, the package lid has been opened, but the lid 106 remains attached to the distal end 140 of the base 110. The arm structure 114, being biased out of the recessed well 136 or attached to the underside of the foil lid 106 at the end, moves out of the recessed well 136 when the lid 106 is removed from the base by the user. The contact lens 138, held between the arms of arms structure 114 moves out of the recessed well 136 with the arm 134 with the lens being lifted out of the solution, which drains away from the lens 138 into the well 136 along one or both arms of the arms structure under the force of gravity. The user then pivots lower arm 144 downward, with the lens 138 being retained on upper arm 134 for transfer to the eye. As illustrated in FIGS. 3C and 3D, the lens 138 is presented to the user, and the user removes the lens 138 from the upper arm 134 and transfers the lens 138 to the eye.

Because the contact lens 138 is lifted out of the recessed well 136 by action of the arm 134, the packaging solution in the well 136 drains away as the contact lens 138 is moved out of the well 136. Moreover, the opening of the lid 106 substantially exposes lens cavity of well 136, with the packaging solution therein, which may remain substantially sterile because the user has not had to reach into the well 136 to remove the contact lens 138.

As shown in FIG. 3C, the user is then able to dab the contact lens 138 with his/her finger 154 to allowing the user to "dab" the contact lens, picking up the contact lens via surface tension for insertion in the wearer's eye. In other words, the user transfers the contact lens 138 from the arm 134 and/or end 135 by tapping (also referred interchangeably as "dabbing") a surface of the contact lens 138 such that the tapping causes the contact lens 138 to release from the arm 134/end 135 and adhere temporarily to the user's finger 154, as illustrated in FIG. 3D. Such single-touch transfer may be enabled by configuring the arm onto which the lens is to be retained for transfer with a shape and position relative to the lens such that the wetted contact area between the lens and the arm is less than about 20 $mm^2$.

In some embodiments, contact lens conveniently may be presented to the user in a convex orientation, meaning that convex side of the lens is accessible to the user without the need to reorient the lens before placing the concave side of the lens onto the wearer's eye surface. Transfer of the contact lens 138 may be performed by a wearer's finger 154, either directly touching the lens or indirectly by way of an applicator film (e.g., as described in US20190046353) or other covering applied to the finger, or may be performed by another transfer means, such as a manual or automatic applicator device or tool. Upon transfer of the contact lens 138 from the package 100, the lens rests on the finger 154 (or other transfer means), as shown in step illustrated in FIG. 3D, with the convex side of contact lens 138 against the finger 154 and the concave side of the lens 138 oriented for direct application to the wearer's eye surface.

In any of the embodiments, the arm may be a strip where one end is the end of the first arm and the other end is the end of the second arm and the strip is attached to the package base at a location on the strip between the ends of the strip and the strip is shaped to form the first arm and the second arm.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Aspects of exemplary embodiments of the invention are further described in accordance with the following clauses:

1. A contact lens package for a contact lens, comprising:
   a package base having a recessed well for receiving said contact lens therein; and
   a first arm and a second arm, wherein the first arm and second arm cooperate to lift the contact lens out of the recessed well, wherein the first arm is configured to engage a first surface of the contact lens and the second arm is configured to engage a second surface of the contact lens.

2. The contact lens package of clause 1, wherein the arm is biased away from the recessed well.

3. The contact lens package of clause 1, wherein surface tension exists between the first arm and said contact lens such that said contact lens is retained on the first arm after the second arm is pivoted away from said contact lens.

4. The contact lens package of clause 1, wherein the first surface of the contact lens is a convex surface of the contact lens and the second surface is a concave surface of the contact lens.

5. The contact lens package of clause 1, wherein the first surface of the contact lens is a concave surface of the contact lens and the second surface is a convex surface of the contact lens.

6. The contact lens package of clause 4, wherein the second arm is connected to the package base adjacent a rim of the recessed well.

7. The contact lens package of clause 1, wherein the first arm and second arm compose a single structure connected to the package base adjacent a rim of the recessed well.

8. The contact lens package of clause 1, wherein the package base comprises a grip region.

9. The contact lens package of clause any preceding clause, further comprising a lid connected to the base, wherein the first and second arms are connected to the base between the recessed well and a location where the lid is connected to the base.

10. The contact lens package of clause 9, wherein the lid is movably connected to the package base such that said lid is movable pivotally with respect to the package base.

11. The contact lens package of clause 9, wherein the lid is foil.

12. The contact lens package of clause 9, wherein the end of the arm is affixed to the lid.

13. The contact lens package of clause 12, wherein the end of the arm is affixed to the lid by welding.

14. The contact lens package of any preceding clause, wherein the recessed well is a blister bowl integral to the package base.

15. The contact lens package of any preceding clause, wherein one or both of the first and second arms comprise polypropylene.

16. The contact lens package of clause 1, wherein one or both of the first and second arms comprise a strip having at least two free edges.

17. The contact lens package of clause 16, wherein the strip has three free edges.

18. The contact lens package of clause 1, wherein the second arm comprises a strip having at least two free edges.

19. The contact lens package of clause 18, wherein the strip has three free edges.

20. The contact lens package of clause 1, further wherein the first arm is configured to have a first wetted contact area with the contact lens larger than a second wetted contact areas between the second arm and the contact lens.

21. A method of presenting a contact lens from a recessed well in a contact lens package to a user, the method comprising:

moving said contact lens from said recessed well by movement of a first and second arms attached to a portion of the contact lens package, said movement from a position of the arm extending into said recessed well and initiated by opening of said contact lens package.

22. The method of clause 21, wherein an end of the first and second arms are biased out of said well by a spring force and held in the recessed well before opening of the said contact lens package by a cover of said contact lens package over the recessed well.

23. The method of clause 21, wherein said contact lens is held to the first arm by surface tension when the contact lens package is in an opened state.

24. The method of clause 21, further comprising:

upon opening of said contact lens package, moving the second arm out of the recessed well, wherein prior to opening of said contact lens package, the second arm extends into the recessed well to a position under said contact lens such that said contact lens is between the first arm and the second arm in the recessed well before opening of said contact lens package.

25. The method of clause 21, wherein the arm is attached to a cover of said contact lens package such that movement of the cover causes the movement of the first and second arms.

26. The method of clause 25, wherein the first and second arms are attached to the cover by welding.

27. The method of any of clause 26, wherein the first and second arms are attached at one end to a package base of said contact lens package.

28. The method of any one of claim 27, wherein the at least one of the first and second arms comprise polypropylene.

29. A method of packaging a contact lens, comprising:

providing a package base with a recessed well;

attaching an end of a first arm to the base at a region adjacent to the recessed well such that another end of the first arm extends into the recessed well;

providing a contact lens adjacent the one end of the arm in the recessed well;

attaching an end of a second arm to the base at a region adjacent to the recessed well such that another end of the second arm extends into the recessed well adjacent to the contact lens;

providing a packaging solution in the recessed well; and sealing the recessed well by applying a cover over the recessed well, the first and second arms, the contact lens and the region adjacent the recessed well.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved and/or single touch packaging. The breadth and scope of the present invention should not be limited by any of the above-described exemplary embodiments but should be defined only in accordance with the following claims and their equivalents.

What is claimed is:

1. A contact lens package for a contact lens, comprising:

a package base having a recessed well for receiving said contact lens therein; and a first arm and a second arm, wherein the first arm and second arm cooperate to lift the contact lens out of the recessed well, wherein the first arm is configured to engage a first surface of the contact lens and the second arm is configured to engage a second surface of the contact lens;

wherein the first arm and second arm are portions of a single strip structure, the strip structure connected to the package base at a location on the strip between the first arm and the second arm;

wherein at least one of the arms is biased away from the recessed well.

2. The contact lens package of claim 1, wherein surface tension exists between the first arm and said contact lens such that said contact lens is retained on the first arm after the second arm is pivoted away from said contact lens.

3. The contact lens package of claim 1, wherein the first surface of the contact lens is a convex surface of the contact lens and the second surface is a concave surface of the contact lens.

4. The contact lens package of claim 1, wherein the first surface of the contact lens is a concave surface of the contact lens and the second surface is a convex surface of the contact lens.

5. The contact lens package of claim 3, wherein the second arm is connected to the package base adjacent a rim of the recessed well.

6. The contact lens package of claim 1, wherein the single strip structure is connected to the package base adjacent a rim of the recessed well.

7. The contact lens package of claim 1, wherein the package base comprises a grip region.

8. The contact lens package of claim 1, further comprising a lid connected to the package base, wherein the first and second arms are connected to the package base between the recessed well and a location where the lid is connected to the package base.

9. The contact lens package of claim 8, wherein the lid is movably connected to the package base such that said lid is movable pivotally with respect to the package base.

10. The contact lens package of claim 8, wherein the lid is foil.

11. The contact lens package of claim 8, wherein an end of at least one of the arms is affixed to the lid.

12. The contact lens package of claim 11, wherein the end is affixed to the lid by welding.

13. The contact lens package of claim 1, wherein the recessed well is a blister bowl integral to the package base.

14. The contact lens package of claim 1, wherein one or both of the first and second arms comprise polypropylene.

15. The contact lens package of claim 1, wherein one or both of the first and second arms comprise a strip having at least two free edges.

16. The contact lens package of claim 15, wherein the strip has three free edges.

17. The contact lens package of claim 1, wherein the second arm comprises a strip having at least two free edges.

18. The contact lens package of claim 17, wherein the strip has three free edges.

19. The contact lens package of claim 1, further wherein the first arm is configured to have a first wetted contact area with the contact lens larger than a second wetted contact areas between the second arm and the contact lens.

20. A method of presenting a contact lens from a recessed well in a contact lens package to a user, the method comprising:

moving said contact lens from said recessed well by movement of first and second arms attached to a portion of the contact lens package, said movement from a position of the arms extending into said recessed well and initiated by opening of said contact lens package;

wherein the first arm and second arm are portions of a single strip structure, the strip structure connected to the contact lens package at a location on the strip between the first arm and the second arm;

wherein an end of at least one of the first and second arms are biased out of said well by a spring force.

21. The method of claim 20, wherein the end of the first and second arms are held in the recessed well before opening of the said contact lens package by a cover of said contact lens package over the recessed well.

22. The method of claim 20, wherein said contact lens is held to the first arm by surface tension when the contact lens package is in an opened state.

23. The method of claim 20, further comprising:

upon opening of said contact lens package, moving the second arm out of the recessed well, wherein prior to opening of said contact lens package, the second arm extends into the recessed well to a position under said contact lens such that said contact lens is between the first arm and the second arm in the recessed well before opening of said contact lens package.

24. The method of claim 20, wherein at least one of the arms is attached to a cover of said contact lens package such that movement of the cover causes the movement of the first and second arms.

25. The method of claim 24, wherein the first and second arms are attached to the cover by welding.

26. The method of any of claim 25, wherein the first and second arms are attached at one end to a package base of said contact lens package.

27. The method of any one of claim 26, wherein the at least one of the first and second arms comprise polypropylene.

28. A method of packaging a contact lens, comprising:

providing a package base with a recessed well;

providing a single strip structure comprising a first arm portion and a second arm portion;

attaching the strip structure to the package base at a location on the strip between the first arm portion and the second arm portion such that an end of the first arm portion and an end of the second arm portion extend into the recessed well;

providing a contact lens adjacent the end of the first arm portion in the recessed well;

providing a packaging solution in the recessed well; and sealing the recessed well by applying a cover over the recessed well, the strip structure, the contact lens and the region adjacent the recessed well.

* * * * *